US005260534A

United States Patent [19]

Chung

[11] Patent Number: 5,260,534

[45] Date of Patent: Nov. 9, 1993

[54] ROCKER SWITCH WITH SPRING-CLAMPED TERMINALS

[76] Inventor: Chien-Lin Chung, c/o Hung Hsing Patent Service Center, P. O. Box 55-1670, Taipei, Taiwan, (10477)

[21] Appl. No.: 994,334

[22] Filed: Dec. 21, 1992

[51] Int. Cl.[5] ..... H01H 21/00

[52] U.S. Cl. ..... 200/553; 200/554; 200/561; 439/188; 439/840

[58] Field of Search ..... 200/553, 554, 556, 561, 200/506, 278; 429/188, 840, 860, 888, 265, 786, 293, 295

[56] References Cited

U.S. PATENT DOCUMENTS 1,350,725 8/1920 Guett ..... 200/554

3,346,710 10/1967 Weston et al. ..... 200/554

*Primary Examiner*—Henry J. Recla

*Assistant Examiner*—David J. Walczak

[57] ABSTRACT

A rocker switch includes a casing composed of a lower base and an upper cover, an input terminal and an output terminal, respectively connected with an input electrical cord and an output electrical cord, and embedded in two sockets disposed in two opposite sides in the lower base, a pair of electrically conductive helical springs each spring retained in each socket for resiliently clamping either input or output cord with either spring and either terminal and for resiliently retaining each terminal in each socket, and an electrical insulative rocker switching device seesawly mounted in the casing for operatively separating two contactor blades respectively protruded from the two terminals for disconnecting a power supply, or for contacting the two contactor blades of the two terminals for connecting the power supply.

8 Claims, 4 Drawing Sheets

ROCKER SWITCH WITH SPRING-CLAMPED TERMINALS

BACKGROUND OF THE INVENTION

A conventional rocker switch includes a rocking button seesawly connecting or disconnecting an input terminal contactor with an output terminal contactor mounted in a switch casing for switching on or off a power supply.

However, such a conventional rocker switch may have the following drawbacks:

1. A tensioning spring should be provided under the rocking button for resiliently actuating the two contactors between the input and output terminals, which however may be easily deformed or resulted in fatigue failure after long time service.

2. The input and output electrical wires should be firmly connected with the input and output terminals respectively by screws causing an inconvenient installation and maintenance job.

3. Many a parts are required for such a conventional rocker switch, which should be well assembled within the switch casing, causing an installation complexity and increase of production and installation cost.

The present inventor has found the drawbacks of the conventional rocker switch and invented the present rocker switch with spring-clamped terminals.

Summary of the Invention

The object of the present invention is to provide a rocker switch including a casing composed of a lower base and an upper cover, an input terminal and an output terminal, respectively connected with an input electrical cord and an output electrical cord, and embedded in two sockets disposed in two opposite sides in the lower base, a pair of electrically conductive helical springs each spring retained in each socket for resiliently clamping either input or output cord with either spring and either terminal and for resiliently retaining each terminal in each socket, and an electrical insulative rocker switching device seesawly mounted in the casing for operatively separating two contactor blades respectively protruded from the two terminals for disconnecting a power supply, or for contacting the two contactor blades of the two terminals for connecting the power supply.

BRIEF DESCRIPTION OF THE DRAWINGS

FIG. 4 is a top view illustration of the present invention when the switch is turned on.

DETAILED DESCRIPTION

Figure 1:
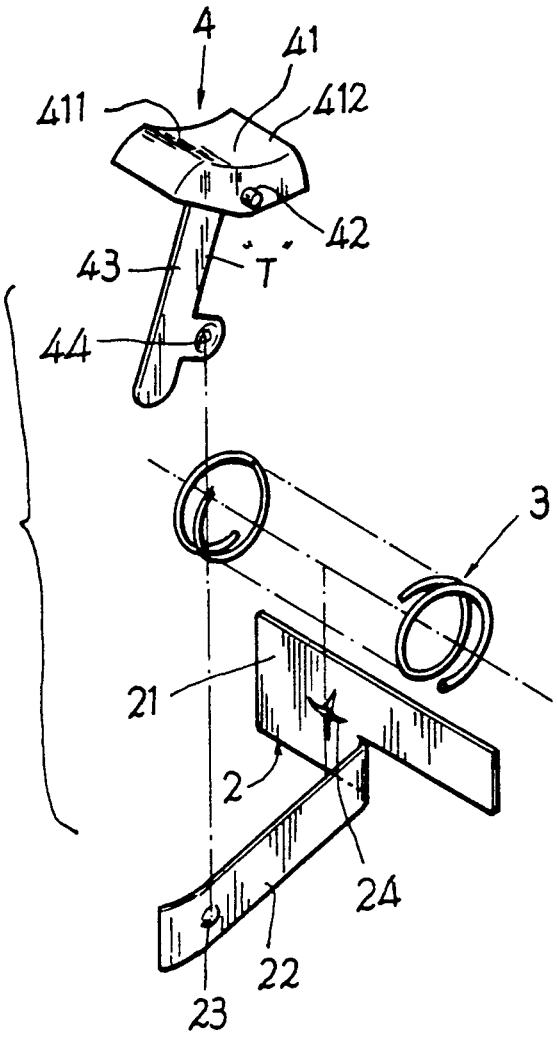
FIG. 1 is an illustration showing several parts of the present invention.
Figure 3:
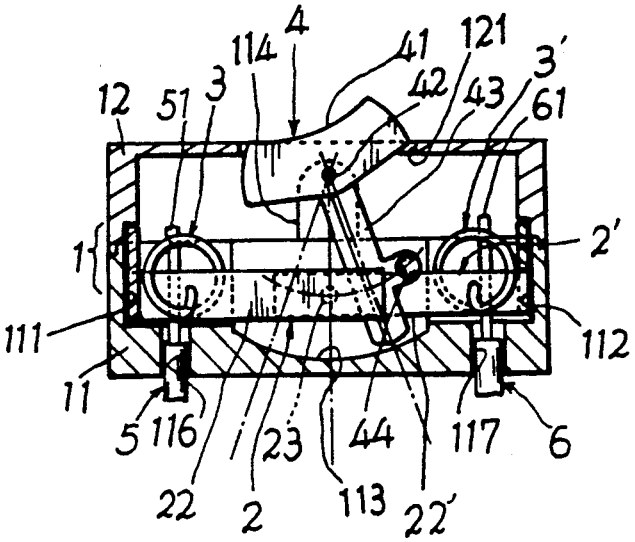
FIG. 3 is a front elevational sectional drawing of the present invention when assembled.
Figure 2:
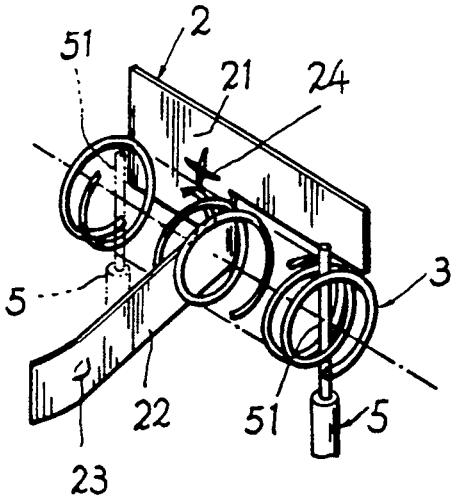
FIG. 2 shows a terminal with a spring for clamping electrical cord thereon in accordance with the present invention.
Figure 4:
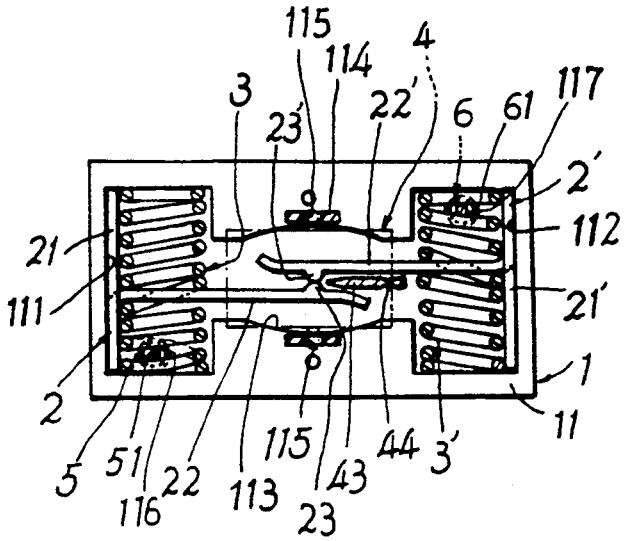

As shown in FIGS. 1-5, the present invention comprises: a casing 1, an input terminal 2 connected with an input electrical cord 5, an output terminal 2' connected with an output electrical cord 6, a first helical spring 3 and a second helical spring 3', and a rocker switching device 4 seesawly mounted in the casing 1. Each terminal 2 or 2' is generally T shaped from a top view thereof.

The casing 1 includes: a lower base 11, and an upper cover 12 combinable with the lower base 11 for forming the casing 1, the upper cover 12 having a button hole 121 formed therein for protruding the rocker switching device 4 upwardly for switching purpose, and the lower base 11 having a first socket 111 and a second socket 112 respectively disposed in two opposite side portions in the base 11 for embedding the input terminal 2 and the output terminal 2' in the two sockets 111, 112, a central cavity 113 recessed in a central portion in the base 11 in between the two sockets 111, 112 and communicating with the two sockets 111, 112, a button bracket 114 protruding upwardly from the base 11 having a pivot hole 115 formed in the bracket 114 for engaging a pivot 42 of the rocker switching device 4 for pivotally mounting the rocker switching device 4 on the casing 1, an input cord hole 116 formed in a bottom of the base 11 communicating with the first socket 111 for inserting the input electrical cord 5 through the input cord hole 116, and an output cord hole 117 formed in the bottom of the casing 1 communicating with the second socket 112 for inserting the output electrical cord 6 through the output cord hole 117.

The input terminal 2 is substantially same as the output terminal 2' which can be formed by an integral molding process, with the two terminals 2, 2' disposed in the two opposite sockets 111, 112 for facing the two terminals with each other.

The input terminal 2, opposite to the output terminal 2', is made of electrically conductive material and includes: a first holding plate 21 embedded in the first socket 111 in the base 11 as packed and retained by the first helical spring 3 in said first socket 111, a first contactor blade 22 protruding towards the central cavity 113 in the base 11 and perpendicular to the first holding plate 21, and a first contactor protrusion 23 (such as made of silver point) formed on an outer end portion of the first contactor blade 22.

The first contactor blade 22 may be directly punched and bent outwardly from the holding plate 21 as shown in FIG. 1 by an integral molding process.

Other shapes, structures or orientation of each terminal 2 or 2' can be modified in this invention and are not limited.

The output terminal 2' is also made of electrically conductive material and includes: a second holding plate 21' embedded in the second socket 112 in the base 11 as packed and retained in the second socket 112 by the second helical spring 3', a second contactor blade 22' protruding towards the central cavity 113 in the base 11 to be juxtapositionally abutted with the first contactor blade 22 and perpendicular to the second holding plate 211, and a second contactor protrusion 23' formed on an outer end portion of the second contactor blade 22' for resiliently contacting the first contactor protrusion 23 of the input terminal 2 for switching on the power supply source led from the input terminal 2.

Either input cord 5 or output cord 6 has a nude wire 51 or 61 insertably held in two neighbouring spring rings of either first helical spring 3 or second helical spring 3' for a firm clamping of either cord 5 or 6 with either terminal 2 or 2'.

The rocker switching device 4 includes: an arcuate button 41 having the pivot 42 formed on a side portion of the arcuate button 41 pivotally engageable with the pivot hole 115 formed in the button bracket 114 formed in the casing 1, and an electrically insulative separating blade 43 protruding downwardly from the arcuate button 41 for operatively separating the two contactor protrusions 23, 23' of the two terminals 2, 2' for disconnecting the power supply source when seesawly biasing the button 41 to position the insulative separating blade 43 between the two contactor protrusions 23, 23' of the two contactor blades 22, 22'.

The button 41 may be formed with "on" and "off" markings 411, 412 on two opposite end portions of the button 41 for clearly indicating the "on" or "off" position of the power supply.

The separating blade 43 of the rocker switching device 4 may be formed with a pair of recesses 44 in two opposite sides of the blade 43 for engaging the two contactor protrusions 23, 23' of the two terminals 2, 2' for a stable positioning of the blade 43 when switching off the power source.

Figure 6:
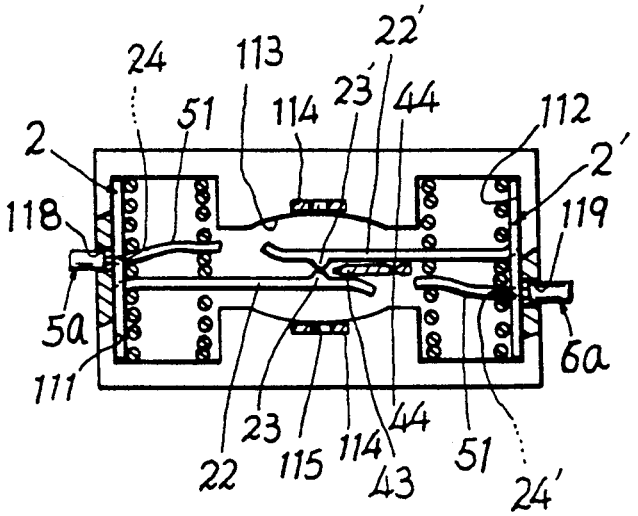
FIG. 6 shows another preferred electrical cord connection of the present invention.

As shown in FIG. 6, two cords 5*a*, 6*a* are respectively inserted into the casing 1 to be connected with the two terminals 2, 21' through two side cord holes 118, 119 formed in two opposite side portions in the casing 1. Naturally, each terminal plate 21, 21' may be perforated or notched (24, 24') to allow a better connection of a wire 51, 61 with the terminal 2, 2' as resiliently retained by the springs 3, 3'.

The present invention is superior to a conventional switch with the following advantages:

1. The parts or elements for constructing the switch of the present invention are so simplified so as to reduce the production cost and to increase the installation or maintenance convenience.

2. As provided with the helical springs 3, 3', the terminals 2, 2' can be firmly embedded in the casing 1 and resiliently clamping of the relevant parts can be effected for a better power connection by the springs of this invention. Meanwhile, the separating blade 43 will ensure the separation of the two contactor blades 22, 22' for affirmatively disconnecting a power supply for electrical safety locking purpose.

3. The rocking button 41 does not require any tensioning spring retained thereunder to thereby prevent the fatigue failure of the conventional spring, so prolonging a service life of the switch.

Figure 5:
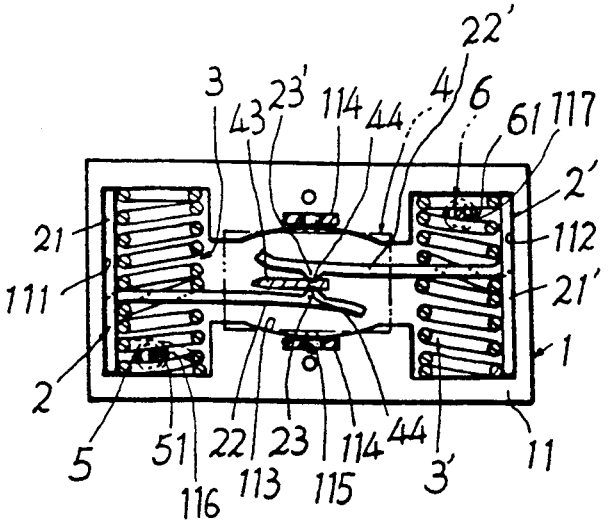
FIG. 5 shows a disconnected switch in accordance with the present invention.

4. As shown in FIG. 5, whenever the separating blade 43 is inserted in between the two contactor blades 22, 22' (protrusions 23, 23'), the two contactor blades 22, 221 is sandwiched with the intermediate separating blade 43 between them 22, 22', thereby preventing "sparking gap" between the input and output terminals 2, 2' for ensuring electrical safety without causing spark for igniting or exploding flammable mixture (if any), and also for preventing oxidation or degradation of the blades 22, 22' since no air gap existing therebetween, thereby prolonging the service life of the switch to be much improved over the conventional switches.

5. The separating blade 43 also serves as a rubbing device frictionally scratching off the rough surfaces on the protrusions 23, 23' for "re-newing" the contacting surfaces of the two contactors 2, 2' for enhancing a better power connection.

The present invention is not limited to the switch as shown in the drawing FIGURES. Other modifications of the switches can be made without departing from the spirit and scope of this invention.

I claim:

1. A rocker switch comprising:

a casing having a first socket and a second socket recessed in two respective opposite side portions in the casing;

an input terminal adapted to be connected with an input electrical cord of a power supply source wherein said input terminal is resiliently embedded in said first socket in said casing and retained in said first socket by a first electrically conductive helical spring in said first socket, said input terminal having a first contractor blade protruding towards a central cavity formed in said casing through a plurality of spring rings of said first spring such that said first contractor blade is electrically connected to said first helical spring;

an output terminal adapted to be connected with an output electrical cord of the power supply source wherein said output terminal is resiliently embedded in said second socket in said casing and retained in said second socket by a second electrically conductive helical spring in said second socket, said output terminal having a second contactor blade protruding through a plurality of spring rings of said second spring such that said second contractor blade is electrically connected to said second helical spring and directed towards the central cavity such that said second contractor blade is resiliently contacted with said first contactor blade for connecting the power supply source from said input cord to said output cord; and a rocker switching device pivotally mounted in said casing and having an electrically insulative separating blade for operatively separating said two contactor blades of said two terminals for disconnecting the power supply source.

2. A rocker switch according to claim 1, wherein said casing includes: a lower base, and an upper cover combinable with the lower base for forming the casing, the upper cover having a button hole formed therein through which the rocker switching device protrudes and the lower base having said first socket and said second socket therein the central cavity recessed in a central portion in the base in between the two sockets and communicating with the two sockets, a button bracket protruding upwardly from the base having a pivot hole formed in the bracket for engaging a pivot of the rocker switching device for pivotally mounting the rocker switching device on the casing, an input cord hole formed in a bottom of the base communicating with the first socket for inserting the input electrical cord through the input cord hole, and an output cord hole formed in the base of the casing communicating with the second socket for inserting the output electrical cord through the output cord hole.

3. A rocker switch according to claim 2, wherein said input terminal is made of electrically conductive material and includes: a first holding plate embedded in the first socket in the base and retained by the first helical spring in said first socket wherein said first contractor blade protrudes towards the central cavity in the base and perpendicular to the first holding plate, and a first contactor protrusion formed on an outer end portion of the first contactor blade.

4. A rocker switch according to claim 3, wherein said contactor blade is directly punched and bent outwardly from the holding plate of said terminal by an integral molding process.

5. A rocker switch according to claim 3, wherein said output terminal is made of electrically conductive material and includes: a second holding plate embedded in the second socket in the base and retained in the second socket by the second helical spring wherein said second contactor blade protrudes towards the central cavity in the base to be juxtapositionally abutted with the first contactor blade and perpendicular to the second holding plate, and a second contactor protrusion formed on an outer end portion of the second contactor blade for resiliently contacting the first contactor protrusion of the input terminal for switching on the power supply source led from the input terminal.

6. A rocker switch according to claim 5, wherein each said cord has a wire insertably held in two neighbouring spring rings of each respective helical spring for firmly clamping and thereby electrically connecting said cord with said terminal.

7. A rocker switch according to claim 2, wherein said rocker switching device includes: an arcuate button having the pivot formed on a side portion of the arcuate button and pivotally engageable with the pivot hole formed in the button bracket formed in the casing, and an electrically insulative separating blade protruding downwardly from the arcuate button for operatively separating the two contactor protrusions of the two terminals for disconnecting the power supply source when the button is positioned such that the insulative separating blade is between the two contactor protrusions of the two contactor blades.

8. A rocker switch according to claim 7, wherein said separating blade is formed with two recesses in two opposite sides thereof for engaging two contactor protrusions of the two terminals for stably positioning the separating blade when switching off a power source.

* * * * *